United States Patent [19]

Jackson

[11] 4,176,805

[45] Dec. 4, 1979

[54] UNWIND STAND-ROLL BRAKE

[75] Inventor: Martin A. Jackson, Saunderstown, R.I.

[73] Assignee: Sheldahl, Inc., Northfield, Minn.

[21] Appl. No.: 954,430

[22] Filed: Oct. 25, 1978

[51] Int. Cl.[2] ..... B65H 23/06

[52] U.S. Cl. ..... 242/75.46; 188/74; 188/195

[58] Field of Search ..... 242/75.46, 75.4, 68.7, 242/78.7, 156; 188/74, 174, 195

[56] References Cited

U.S. PATENT DOCUMENTS

| | | | |
|---|---|---|---|
| 1,270,279 | 6/1918 | Ferres | 242/75.46 |
| 2,285,939 | 6/1942 | Neumair | 242/75.46 |
| 2,877,963 | 3/1959 | Hayden | 242/75.46 X |

FOREIGN PATENT DOCUMENTS

| | | | |
|---|---|---|---|
| 2142876 | 3/1973 | Fed. Rep. of Germany | 188/195 |

*Primary Examiner*—Harvey C. Hornsby
*Assistant Examiner*—John M. Jillions
*Attorney, Agent, or Firm*—Orrin M. Haugen; Thomas J. Nikolai

[57] ABSTRACT

A braking system for applying a controllable braking force to the support shaft of a film supply roll, wherein the braking force is proportional to the weight of film remaining upon the supply roll, and wherein the braking force decreases as the supply of film remaining on the supply roll decreases. The system utilizes a pair of brake yokes which are mounted on opposed sides of the frame of an unwind stand, with each brake yoke having a generally "U" configuration, and with the support shaft for the film supply roll being received within the "U" shaped member. The yokes are mounted upon rams which are controllably elevated, and when elevated, a friction pad which lines the inner periphery of the yoke makes contact with the support shaft. The rams are arranged to reciprocatorily raise and lower the yokes for bringing the friction material into and out of contact with the support shaft so as to provide controlled braking when required. The braking system of the present invention is employed during periods of temporary shut-down of the apparatus, and is normally not employed to establish a running tension in the film web during normal machine operation.

6 Claims, 4 Drawing Figures

UNWIND STAND-ROLL BRAKE

BACKGROUND OF THE INVENTION

The present invention relates generally to an improved braking system for film supply systems, and more particularly to a braking system for a film supply roll which utilizes a supply roll shaft and a generally "U" shaped shaft receiving yoke having an open top to permit ease of access for replacing an exhausted film supply roll with a fresh roll and having a friction material lining the base of the yoke to provide for controllable braking of the shaft upon interruption of operation.

In the utilization of webs of flexible films, such as in the manufacture of film products such as bags and the like, the film supply or web is normally provided in the form of a wound supply roll mounted upon an unwind stand from which the film is fed to the converting equipment. Normally, the equipment draws film to a converting station on an intermittent draw basis, and occasionally during the operation of the equipment, the converting machinery may be shut-down temporarily for one reason or another. While compensator systems employing a plurality of dancer rolls are provided for controlling the supply of film to the equipment during the normal intermittent operation of the draw rolls, means must be provided for controlling and braking the residual inertial rotational motion of the supply roll as the machine is stopped so that additional quantities of film are not uncontrollably unwound from the supply roll to thereby alter, or even eliminate any residual tension that may be present in the film web.

In the past, it has been conventional to utilize drag mechanism which make contact with the surface of the flexible film, and thus provide a restraint against continuous free-running of the film supply roll. These drag systems have normally employed canvas bags carrying a weight which frictionally engages the outer surface of the supply roll, and specifically that portion of the supply roll which comprises the film web leaving the supply roll for entry into the converting equipment. While these canvas drag systems have generally been useful for establishing web tension and, in fact, maintaining web tension, these canvas drag systems have not proven to be satisfactory for controlling the rolling of the supply roll upon interruption of machine motion. Excessive weight of the canvas drag may cause surface damage or scratching of the film. Lesser weights, on the other hand, while not adversely affecting the surface finish of the film, may not provide adequate drag forces to properly control the supply roll during shut-down. In other words, if the weight of the drag is controlled so as to not adversely affect the surface of the film web, that weight may be insufficient to properly control the free-running or rotation of the supply roll. It will be appreciated, of course, that the weight of the supply roll varies continuously as the quantities are consumed in the converting equipment, and frequently the weights available in the canvas drag systems are only sufficient to control the roll when it is partially or nearly consumed, and thus of a weight significantly less than a full roll. Normally, the weighted canvas drags provide a continuous drag on the roll so as to maintain working tension on the roll, and for ordinary systems employing the improved brake of the present invention, such canvas drags or weights will continue to be employed. Recently, however, converting equipment has been developed which runs at higher rates of speed, and with these higher speed machines, the braking torque provided by the canvas weights or drags have been found to be inadequate for shut-down. Consequently, when the operation of such a machine is interrupted, an inordinate amount of slack in the film may develop because of the inability of the canvas weights or drags to provide the necessary braking force to stop the inertial rotational motion of the supply roll.

Various braking systems have been proposed for film supply rolls which utilize brake shoes or drums which substantially entirely enclose or envelope the supply roll support shaft. While such systems are effective for applying controllable braking forces to the support shaft, these systems are undesirable from the standpoint that the braking systems must be partially disassembled in order to permit replacement of the film supply roll.

SUMMARY OF THE INVENTION

In accordance with the present invention, a braking system is provided for film supply rolls which is effective for various weights of supply rolls, and which permits ready replacement of supply rolls as required. The braking force applied to the roll is directly proportional to the weight of the roll, thereby providing a greater degree of effective control over the film supply roll. The braking system of the present invention utilizes the weight of the supply roll as a directly proportional factor in generating the braking force applied to the roll, thus controlably reducing the braking force applied to the roll as the supply is reduced. In the present arrangement, the braking force generated is substantially proportional to the weight of the roll, which has been found to be a practical working arrangement. The braking torque is equal to the product of the braking force times the radius of the shaft to which the force is applied. Normally, the braking torque required to stop a rotating supply roll is proportional to the square of the roll radius. In the present arrangement, the braking torque which is generated is proportional to the product of the braking force and the radius of the shaft. This is, of course, superior to the canvas weight or drag arrangement which provides only a substantially fixed or predetermined drag.

The braking system of the present invention utilizes a pair of brake yokes which are mounted for reciprocable up and down motion on opposed sides of the frame of an unwind stand, with each of the yokes having a generally "U" shaped shaft receiver. The base of the inner periphery of the shaft receiver is in the form of an arcuate segment which, when raised to braking disposition, is generally concentric with the axis of the support shaft, with this surface being in the form of a friction pad which frictionally restrains free rotation of the support shaft when the support shaft is in contact with the friction pad. The means which are provided for reciprocatorily raising and lowering the brake yokes brings the periphery of the support shaft into and out of contact with the friction pad so as to provide a braking force upon approximately 180° of the support shaft when braking is indicated. Normally, means are provided for raising the brake yokes into contact with the support shaft whenever normal film draw is interrupted.

Therefore, it is a primary object of the present invention to provide an improved braking system for braking the rotation of film supply rolls supplying a working web of film to a converting apparatus.

It is a further object of the present invention to provide an improved braking system for a film supply roll delivering flexible film in the form of a web to an intermittently operated film draw system, the arrangement utilizing a pair of generally "U" shaped support shaft receivers, with the open top of the "U" shaped receivers permitting ease of accessibility for replacing spent film supply rolls with fresh supply rolls.

It is yet a further object of the present invention to provide an improved braking system for a film supply roll wherein the braking system is energized upon the occurrence of an interruption of film draw from the film supply roll.

Other and further objects of the present invention will become apparent to those skilled in the art upon a review of the following specification, appended claims, and accompanying drawings.

IN THE DRAWINGS

FIG. 1 is a side elevational view of a film unwind stand equipped with the braking system of the present invention, and with certain features and components of the braking system being shown schematically;

DESCRIPTION OF THE PREFERRED EMBODIMENT

Figure 2:
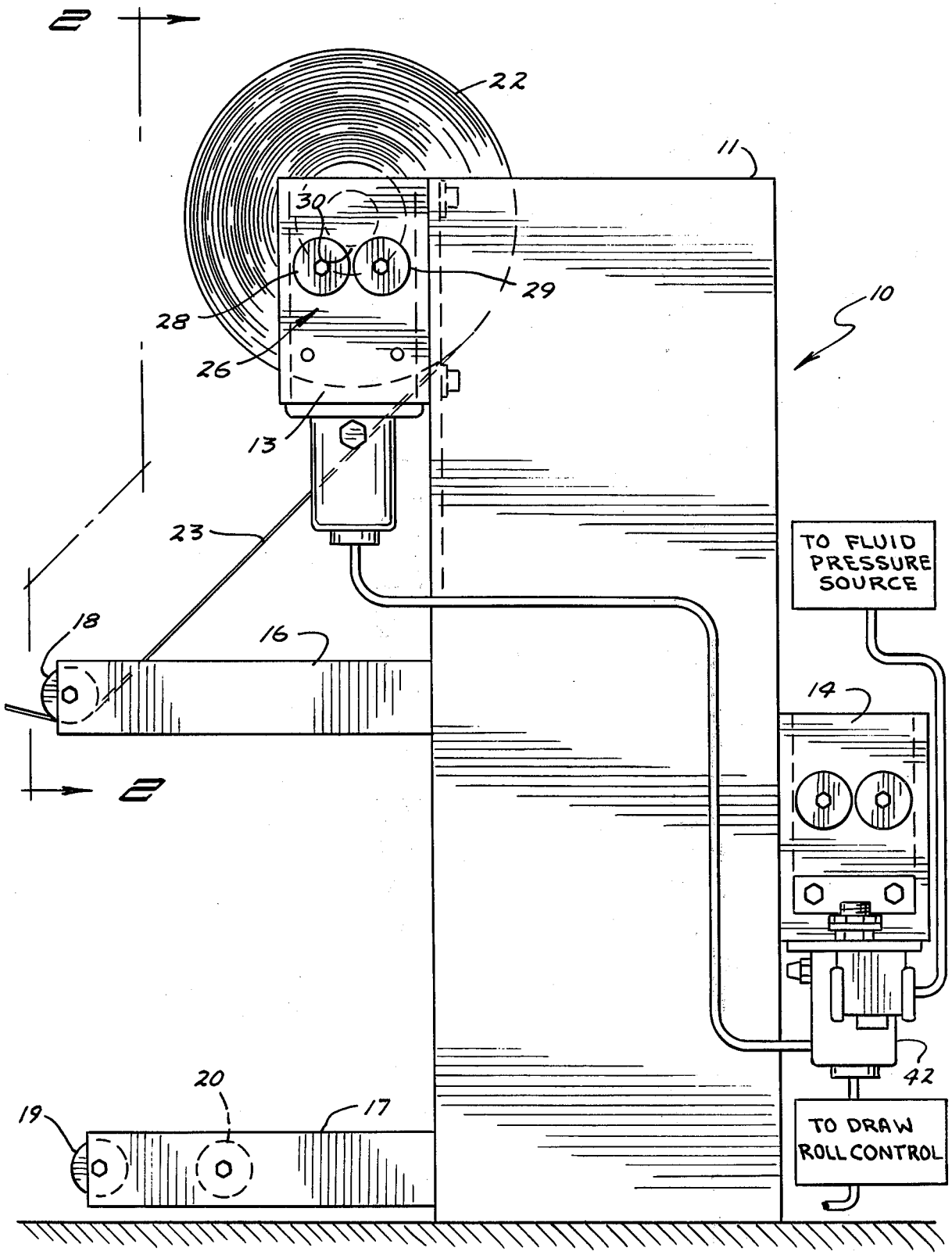
FIG. 2 is a vertical sectional view of the unwind stand shown in FIG. 1, with FIG. 2 being taken along the line and in the direction of the arrows 2—2 of FIG. 1, with portions of the frame means of the unwind stand being cut away to illustrate certain features of the structure.
Figure 2:
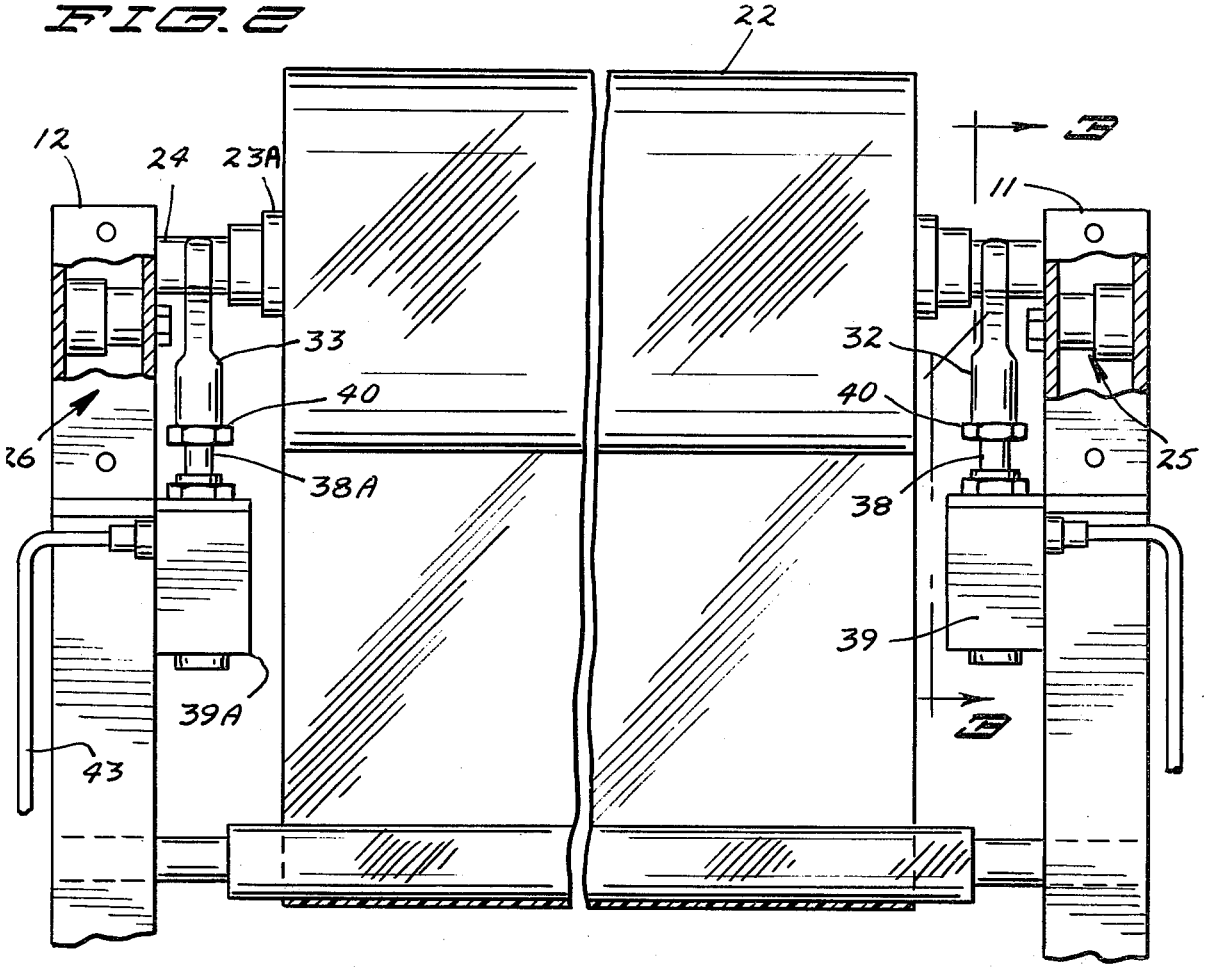

In accordance with the preferred embodiment of the present invention, and with particular attention being directed to FIGS. 1 and 2 of the drawings, the unwind stand generally designated 10 comprises a pair of side frames 11 and 12 having a pair of film supply roll receiving stations generally designated 13 and 14 secured thereto. The side frames 11 and 12 are each provided with upper and lower arms 16 and 17, with these arms having journalled for rotation therewithin idler rolls as at 18, 19 and 20 for enhancing and accommodating control of the web being drawn from the supply roll. It will be appreciated, of course, that unwind stands are common in the art, with each converting machine normally being provided with at least one unwind stand.

As is apparent in FIG. 1, a supply roll is present in station 13, with station 14 being shown, for purposes of simplification, free of a supply roll. Normally, two roll receiving stations are provided in order to permit web splices to be prepared, such as a flying splice to accommodate continuous operation of the converting equipment. The machine operator will, of course, accomplish replacement of the exhausted film supply whenever required. Accordingly, supply roll 22 is shown delivering a web of film 23 onto a remote converting machine, the converting machine not being shown. Running drag torque for web tension may be applied to the supply rolls through conventional means, such as with the weighted canvas friction straps.

With attention now being directed to FIG. 2 of the drawings, it will be seen that supply roll 22 is wound about core 23A, with core 23A being, in turn, received upon support shaft 24. Support shaft 24 is journably supported for free axial rotation upon opposed pairs of support rollers, with one pair of support rollers being shown generally at 25, and with the other being shown generally at 26. These support rollers include a pair of individual rollers as at 28 and 29, with rollers 28 and 29 being mounted for free rotation upon parallelly disposed axes. The space between the individual rollers 28 and 29, as indicated at 30, provides a support cradle for the support shaft 24, as is apparent in FIG. 1. It will be appreciated, of course, that the details of each of the receiving stations 13 and 14 are identical, one to another, and hence detailed reference need only be made to one of these stations.

Figure 3:
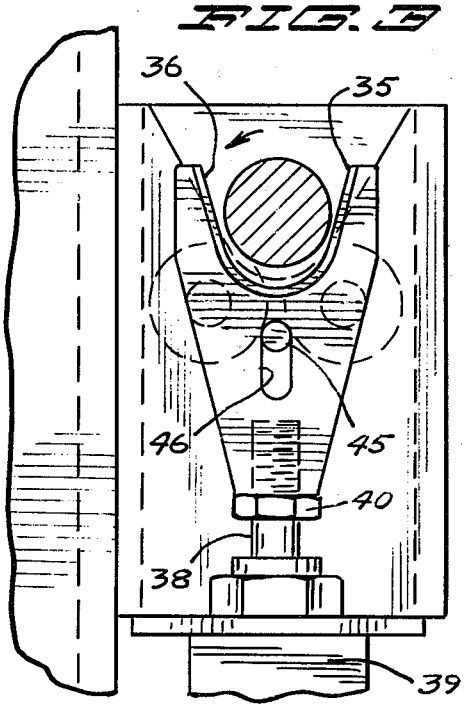
FIG. 3 is a detail vertical sectional view taken along the line and in the direction of the arrows 3—3 of FIG. 2, and illustrating the disposition of the braking system during free running of the film supply roll.
Figure 4:
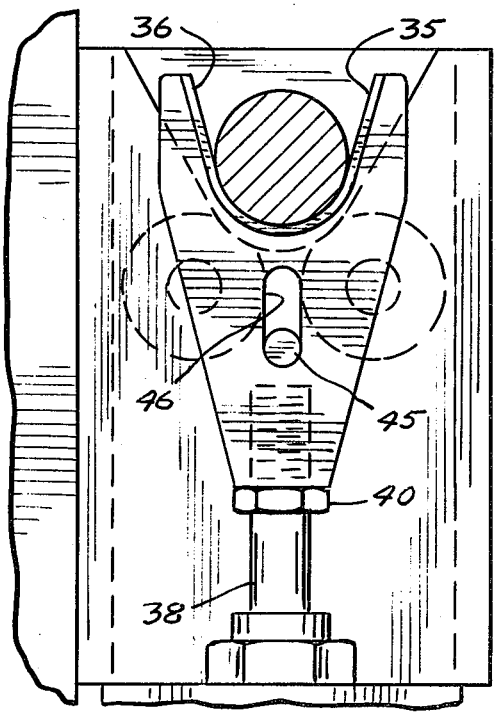
FIG. 4 is a view similar to FIG. 3, and illustrating the disposition of the braking system with the brake yokes actuated and in elevated supply roll braking disposition.

With continued specific attention being directed to FIG. 2, it will be seen that each of the side frames 11 and 12 is provided with a brake yoke, such as the brake yokes 32 and 33. It will be appreciated further that each of the individual supports for the support shaft in the side frames is identical, one to another, with the only exception being that the two form mirror images of each other. Accordingly, brake yokes 32 and 33 include a generally "U" shaped shaft receiver, such as is shown in FIGS. 3 and 4, the inner periphery of the shaft receiver being covered with a friction material such as at 36. The layer of friction material such as at 36 provides a facing for the shaft receiver and may be fabricated from conventional brake composition substances. Such brake composition substances are, of course, commercially available, with natural leather being suitable for application.

Each of the brake yokes is mounted upon a ram, such as ram 38 which extends from cylinder 39. Ram 38 has an adjustment nut 40 secured thereto for accommodating appropriate elevational adjustment of the brake yokes such as yoke 32. Cylinder 39 is conventional, and is, in this case, an air cylinder operated by an appropriate solenoid valve as at 42 (FIG. 1), and supplied with compressed air through line 43. As has been previously stated and repeated here for simplicity, supply roll receiving station 14 is, of course, identical to station 13, and the supply of compressed air is coupled in parallel between the two stations.

Attention is now directed to FIGS. 3 and 4 of the drawings wherein the operation of the brake yokes is illustrated. In FIG. 3, the friction pad or facing 36 is shown spaced from the periphery of shaft 24. This will be the normal running condition for the system, with this arrangement providing for free rotational support of shaft 24 within support rollers 28 and 29. Support rollers 28 and 29 provide only minimal rolling friction for the system upon normal operation. Also, as is apparent, ram 38 of cylinder 39 is shown in retracted disposition. In FIG. 4, however, ram 38 is shown in extended disposition, thereby engaging the periphery of shaft 24 with the friction pad or facing 36, and providing a braking action for the supply roll support shaft. Since the arcuate segment of the generally "U" shaped shaft receiver is generally concentric with the support shaft, the arcuate contact between the support shaft and the friction pad is nearly at its maximum of 180°, thus providing a substantial area of contact for exerting braking action or generation of braking torque.

In order to provide appropriate control of the braking system of the present invention, solenoid valve 42 is actuated when the draw rolls are actively drawing web 23 into the converting machine. Therefore, with the machine operating and solenoid 42 actuated, brake yokes 32 and 33 are retracted due to the retraction of ram 38 in cylinder 39, or, in the case of yoke 33, ram 38A and cylinder 39A. When power is interrupted to the draw rolls and the draw rolls are deactivated, solenoid valve 42 reacts so as to permit cylinders 39 and 39A to assume a normal or elevated disposition such as is illustrated in FIG. 4. The reciprocatory raising and lowering of the brake yokes 32 and 33 is controlled by a guide stud within a running slot, such as guide stud 45 received within running slot 46 formed within each of the brake yokes, such as yoke 32 shown in FIG. 3.

In the event it is desirable to increase the braking force required for individual applications, the area of contact between the shaft and the friction material may be increased. This may be accomplished by either increasing the width of the friction material, or alternatively, by increasing the diameter of the shaft at the ends thereof. An added advantage of an increase in the shaft diameter would be the proportionate increase in braking torque delivered to the system.

Accordingly, the braking system of the present invention is one which provides improved control over the braking torque applied to the support shaft of a film supply roll, with the braking torque being generally porportional to the weight of the film supply remaining on the supply roll. Accordingly, the braking system is well adapted for use on high speed converting equipment, with the braking system being responsive to and generally controlled by the film draw system.

I claim:

1. Braking system for applying a controllable braking torque to the support shaft of a film supply roll arranged to provide a supply of flexible film to an intermittently operated film draw system, said braking system comprising:

(a) frame means, a support shaft for supporting a film supply roll therearound, bearing means journably supporting said support shaft for free axial rotation within said frame means and including at least two pairs of support rollers with one pair being mounted at each end of said support shaft and arranged in axially spaced apart parallel relationship with said support rollers being journaled for rotation within said frame means and providing a free rotational support cradle for said support shaft therebetween;

(b) a pair of brake yokes mounted on said frame means with one being disposed at each opposed end of said support shaft, each brake yoke comprising a generally "U" shaped shaft receiver with the base of the inner peripheral surface of said shaft receiver being an arcuate segment generally concentric with said support shaft and having an outer shaft contacting surface formed as a friction pad for frictionally restraining free rotation of said support shaft when in contact therewith; and (c) means for reciprocatorily raising and lowering said brake yokes for bringing said shaft contacting surface into and out of contact with said support shaft to provide lifting support of said support shaft and frictional engagement and braking between said friction pad and the periphery of said support shaft when said brake yokes are raised and to permit free rotation of said support shaft upon said support rollers when said brake yokes are lowered.

2. The braking system as defined in claim 1 being particularly characterized in that said means for reciprocatorily raising and lowering said support shaft maintains said brake yokes in lowered disposition only when flexible film is being drawn from a supply roll mounted on said support shaft.

3. The braking system as defined in claim 1 being particularly characterized in that said means for reciprocatorily raising and lowering said brake yokes include pneumatic cylinders.

4. The braking system as defined in claim 3 being particularly characterized in that said pneumatic cylinders are operationally coupled to the film draw system.

5. Braking system for applying a controllable braking torque to the support shaft of a film supply roll arranged to provide a supply of flexible film to an intermittently operated film draw system, said braking system comprising:

(a) frame means, a support shaft for supporting a film supply roll therearound, bearing means journably supporting said support shaft adjacent the ends thereof for free axial rotation within said frame means, and providing a rotational support cradle for said support shaft therebetween;

(b) a pair of brake yokes mounted on said frame means with one being disposed at each opposed end of said support shaft, each brake yoke comprising a generally "U" shaped shaft receiver with the base of the inner peripheral surface of said shaft receiver being an arcuate segment generally concentric with said support shaft and having an outer shaft contacting surface formed as a friction pad; and (c) means for controllably reciprocatorily raising and lowering said brake yokes for bringing said friction pad into and out of contact with said support shaft to provide lifting support of said support shaft and the generation of a braking force between the surface of said friction pad and the periphery of said support shaft when said brake yokes are raised and to permit free rotation of said support shaft upon said bearing means when said brake yokes are lowered.

6. The braking system as defined in claim 5 being particularly characterized in that said bearing means journably supporting said support shaft include support rollers disposed at opposed ends of said support shaft, and wherein the braking force generated between the surface of said friction pad and the periphery of said support shaft is generally proportional to the weight of the film supply roll retained therewithin.

* * * * *